United States Patent [19]

Hense et al.

[11] 4,124,973

[45] Nov. 14, 1978

[54] THICK AND THIN YARN AND PROCESS THEREFOR

[75] Inventors: Karl-Hermann Hense, Erlenbach; Rudolf Heb, Elsenfeld; Thomas Zang, Hosbach, all of Fed. Rep. of Germany

[73] Assignee: Akzona Incorporated, Asheville, N.C.

[21] Appl. No.: 786,327

[22] Filed: Apr. 11, 1977

[30] Foreign Application Priority Data

Apr. 15, 1976 [DE] Fed. Rep. of Germany ..... 2616786

[51] Int. Cl.[2] ..... D02G 1/02; D02G 3/34; D02G 3/38

[52] U.S. Cl. ..... 57/207; 57/208; 57/6; 57/284

[58] Field of Search ..... 57/144, 140 R, 140 J, 57/160

[56] References Cited

U.S. PATENT DOCUMENTS

| | | | |
|---|---|---|---|
| 2,731,789 | 1/1956 | Holder | 57/144 X |
| 3,403,501 | 10/1968 | Nuissl | 57/160 X |
| 3,763,640 | 10/1973 | Nagel et al. | 57/144 X |
| 3,945,189 | 3/1976 | Allen | 57/140 J X |
| 3,952,496 | 4/1976 | Nagel et al. | 57/144 |
| 4,010,601 | 3/1977 | Anahara et al. | 57/160 |

*Primary Examiner*—Charles Gorenstein
*Attorney, Agent, or Firm*—Tom R. Vestal; Francis W. Young

[57] ABSTRACT

A nubby yarn comprising at least one textured core yarn and one separately textured effect yarn is disclosed wherein the effect yarn is periodically wrapped helically around the core yarn and then helically wound over the first helix in the same direction of wind. A process for the manufacture of the nubby yarn is also disclosed.

9 Claims, 2 Drawing Figures

THICK AND THIN YARN AND PROCESS THEREFOR

Core-effect yarns are known in which nubby sections of yarn are formed along the length of the yarn by, for example, air twisting jets. The nubby sections are formed by uncontrollable wrappings of the effect yarn around the core yarn. The wrappings change direction randomly through the nub.

Where the effect yarn wrap changes directions wind around the core, an unstable end if formed. These unstable ends separate from the nub in further processing and cause problems in further processing of the yarn as well as create deficiencies in the fabrics made therefrom.

BRIEF DESCRIPTION OF THE PRESENT INVENTION

The purpose of the present invention is to manufacture a core-effect yarn combination having along its length a series of nubby thickenings wherein the effect yarn is helically wrapped around the core yarn a determined distance and reversed in lengthwise direction but continually constant direction helically wound back over the preceding segment to firmly lock the segment in position to thus insure sufficient resistance to shifting.

The core and/or effect yarns may be "flat" (untextured) yarns, with or without twist. The resultant combination will have little bulk and relatively harsh hand. Preferably, however, a combination having high bulk and good covering power is formed by the use of textured (falsetwist, stuffer box, asymmetric or otherwise crimped) core and/or effect yarns. False twist — textured yarns yield especially favorable results.

The yarn of the present invention can be formed on existing equipment — e.g., ring twisters and draw twisters — with slight modification. Falsetwist texturing machines are preferable in that the texturing of the yarns or a part thereof may be incorporated into the process. The effect yarn may be converged into the core yarn in the falsetwist texturing process.

On a falsetwist texturing machine, the effect yarn is converged into the core yarn with the help of a guide that periodically moves upward down a determined distance along the length of the core yarn.

The process according to the invention is characterized in that the effect yarn converges on the core yarn emerging from the heating zone via a thread guide located in the direct vicinity of the core yarn and performing with respect to the latter an essentially parallel, periodic traverse motion, whereby the velocity of thread guide, when moving in the direction of travel of the core yarn, is greater than the travel speed of said core yarn.

The effect yarn is fed essentially free from tension wraps around the core yarn in the form of a helical line with helices of constant direction as a result of the twist imparted by the twister backing up through the heating zone to the twist stop. This wrapping represents in the area of nubby thickenings the lowermost part of the helical sheath. The thread guide, on which the effect yarn converges on the core yarn, moves suddenly in the direction of travel of the core yarn at a rate of speed greater than the travel speed of the core yarn, whereby the continuously running effect yarn wraps once more the wrapped core yarn with a second helical sheath but whose helices run in the opposite direction. A third helical sheath, with helices running in a direction opposite from that of the helices of the second sheath will be formed when the thread guide returns to its original position. These three overlying sheaths form the nubby thickenings.

The length and spacing of these nubby thickenings can be controlled by means of the length of the path covered by the thread guide, via which the effect yarn converges on the core yarn, in the direction of travel of the core yarn, as well as by means of the time intervals between thread guide motions. The density of the nubby thickenings can be controlled via the difference between the speed of the thread guide and that of the core yarn. Using suitable means, it is also possible here to obtain thick-thin yarn exhibiting nubs of varying length and/or density.

In the process according to the invention tying in of the core yarn by the effect yarn is thus accomplished first by the twist backing up from the twister in the direction of the twist stop. When passing the twister, the core yarn which has a set twist, is untwisted to zero twist. The core yarn thereby assumes bulk. When passing the twister, the effect yarn wrapping on the core yarn is wound more firmly on the core yarn, resulting in increased cohesion between core and effect yarn, which has a particularly favorable effect in the zones of nubby thickenings.

The serviceability of the thick and thin yarn obtained in this manner is improved according to a special version of the process of the invention in that once the thick and thin yarn has left the falsetwisting zone, the effect yarn is interlaced in spots with the core yarn. In the state of the art, a great number of suitable tangling jets are known.

A high bulk thick and thin yarn is obtained, when the effect yarn is fed to the thread guide from a direction opposite the travel direction of the core yarn. For instance, if the falsetwist-texturing unit operates from top to bottom, the effect yarn is fed by preference from the bottom to the thread guide. If the falsetwist-texturing unit operates from bottom to top, it is expedient to feed the effect yarn to the thread guide from the top. To obtain an especially bulky thick and thin yarn, it is also expedient to use a falsetwist-textured yarn as effect yarn.

The process of the invention can be carried out with practically any synthetic yarn which is conventionally used for falsetwist-texturing, especially yarn made from polyamides, such as polyhexamethylene adipamide or polycaprolactam, from polyacrylonitrile or from polyester, especially polyethylene terephthalate and polymethyl ethylene terephthalate.

The process of the invention can be carried out on virtually all known falsetwist-texturing equipment. Merely the installation of an effect yarn supply and a thread guide performing a periodic traverse motion parallel to the core yarn is required. It is thus possible to use an oscillating fork carrying at one end the thread guide for the effect yarn, whereas a cam sets the other end in motion. Using a cam of a suitable design, it is possible to reciprocate a slow forward motion with a very rapid return motion of the thread guide. Another possibility is to provide parallel to the direction of travel of the core yarn, a pneumatically actuated piston on which the thread guide for the effect yarn is mounted laterally. The movement of the piston can be controlled so that a certain time intervals said piston moves a short distance at a speed greater than the speed of the core yarn in the direction of the core yarn and subsequently reverses, more or less rapidly, to its original position. Other possibilities to achieve the prescribed motion of the effect yarn thread guide are conceivable, e.g., by electromagnetic or purely mechanical means.

The process according to the invention can be combined in a known manner with other process phases. In particular, it is possible to use as feeder yarn for the falsetwist-textured process, not drawn yarn but rather an undrawn or partly drawn yarn as core yarn and to draw the latter either immediately in front of the texturing zone (sequential process) or in the texturing zone (simultaneous process). The texturing process can be preformed at conventional speeds of, e.g., 100 to 600 m/min.

The thick and thin yarn of the invention is especially suitable for the production of high fashion printable fabrics or knits, in particular, shirting and blouse materials, as well as for light print ladies' garments.

BRIEF DESCRIPTION OF THE DRAWINGS

The invention is explained in greater detail on hand of the enclosed drawing wherein.

DETAILED DESCRIPTION OF THE DRAWINGS

Figure 1:
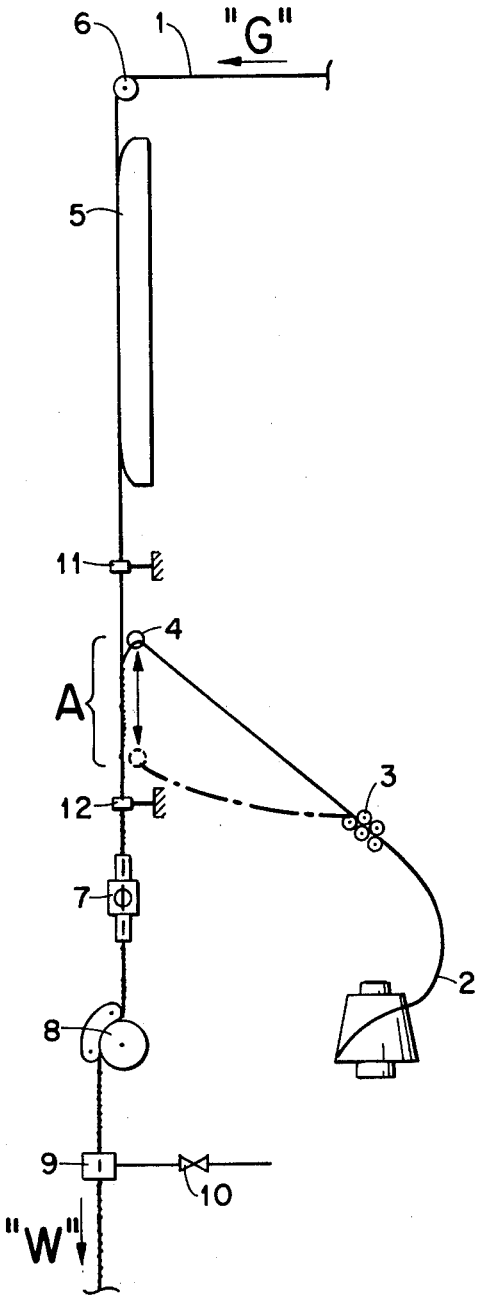
FIG. 1 is a schematic illustration of a portion of the falsetwist-texturing machine.

Core yarn 1 travels — coming from a feed unit (not shown) — in the direction of arrow G to a conventional falsetwist-texturing unit. Essential elements of such falsetwist-texturing unit are the twist stop 6, the twister 7 (here: a conventional falsetwisting spindle) and heating device 5. A second feed unit 8 withdraws the yarn from the texturing zone. The twist applied by twister 7 to core yarn 1 runs upstream in the direction of twist stop 6, whereby said core yarn becomes set by the effect of the heat generated by heating device 5 and the cooling taking place between heating device 5 and twister 7. The zone located between twister 7 and twist stop 6 is designated as falsetwisting zone. According to the invention, effect yarn 2 is allowed to converge in an essentially tension-free state on core yarn 1 emerging from heating device 5. Yarn tension device 3 serves merely to maintain a constant low tension in effect yarn 2. Said effect yarn travels on a thread guide 4 to which a periodic, reciprocating motion can be imparted essentially parallel and immediately adjacent to core yarn 1, which thread guide is shown in the normal position of FIG. 1. At short time intervals, thread guide 4 is displaced at a speed which is greater than the travelling speed of core yarn 1, over a certain zone A in the direction of travel of core yarn 1. Subsequently, said thread guide is slowly returned to its original position. The nubby thickenings of the thick and thin yarn according to the invention, as shown in FIG. 2, are formed during the reciprocating motion of thread guide 4.

Figure 2:
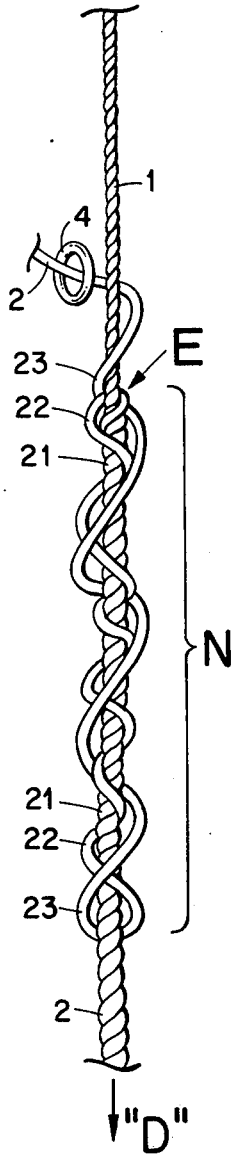
FIG. 2 is a highly magnified section of the thick and thin yarn directly adjacent to the effect yarn thread guide immediately after formation of a nubby thickening.

In FIG. 2, arrow D designates the direction of travel of core yarn 1, on which is wrapped effect yarn 2 in the form of a narrow helical line 21. At the moment at which thread guide 4 moves about zone A (FIG. 1) at a speed greater than the travel speed of and in the direction of travel of core yarn 1, converging effect yarn 2 overtakes at point E, while changing the direction of shear of the helical line, core yarn 1, which has already been wrapped once. The second helical sheath 22 is formed thereby. At the end of zone A, when thread guide 4 reverses direction, the helical line of effect yarn 2 changes again direction of shear. Said effect yarn is now wrapped as a third sheath 23 about the twice-wrapped core yarn 1. When thread guide 4 is back in its original position, effect yarn 2 starts once more to wrap in close helices around core yarn 1. In zone N of the thick and thin yarn, core yarn 1 is thus wrapped with three overlying sheaths 21, 22 and 23. Due to the process technique, the pitch of helical sheaths 22 and 23, compared with that of base wrapping 21, is in part considerably higher.

As the resulting thick and thin yarn passes twister 7, both core yarn 1 in which the twist has been set, and effect yarn 2 sheathing said core yarn 1 are twisted back at full speed of twister 7 opposite the direction of the set twist of cone yarn 1. Core yarn 1 assumes thereby the bulk typical of falsetwist-textured yarns, whereas effect yarn 2 is subjected to a reversal of its travel directions with reductions of the absolute number of turns per unit of length. These turns are, however, adequate to confer sufficient cohesion to the thick and thin yarn. Especially at the nubby thickenings, a good cohesion between effect yarn 2 and core yarn 1 is provided by the helices of helical sheaths 22 and 23.

To confer sufficient cohesion for further processing to the area between the nubby thickenings of the thick and thin yarn being drawn off the second feed unit 8, said thick and thin yarn travelling in direction of arrow W to the winding point is intermittently tangled by means of a known jet 9, which is supplied with air via valve 10.

In FIG. 1, the periodically traversing thread guide 4 is located between heating unit 5 and twister 7. This arrangement is preferred since the number of turns in core yarn 1 is highest in this area of the falsetwisting zone and a favorable effect can thus be achieved. To stabilize the yarn travel, thread guides 11, 12 may be mounted upstream and downstream of Zone A of traversing thread guide 4.

The length N of the nubby thickenings, as well as the thickness of the nubs can be controlled via the length of zone A and the speed at which thread guide 4 is moved from its normal position along said zone A in the direction of travel of core yarn 1.

It can be seen from the above description that numerous embodiments of the invention may be contemplated. The above disclosure is not to be limiting in scope but shall be determined by the scope of the claims below.

What is claimed is:

1. A yarn comprising at least one textured core and one separately textured effect yarn, wherein the core yarn is covered periodically along the length with two or more helical wraps of the effect yarn to form a nubby thickening, the helical wraps being reversed in each adjacent wrap but characterized by a constant helical direction.

2. Thick and thin yarn according to claim 1, characterized in that the core yarn and effect yarn are separately falsetwist-textured yarns.

3. Thick and thin yarn according to claim 1, characterized in that the core yarn is falsetwist-textured.

4. Thick and thin yarn according to claim 1, characterized in that the effect yarn is falsetwist-textured.

5. A thick and thin yarn according to claim 1, characterized in that the distance between the ends of (E) of two consecutive nubby thickenings (N) is between 2m and 15m.

6. A process for the manufacture of a thick-and-thin yarn comprising the steps of:

(a) separately texturing an effect yarn, (b) feeding a core yarn to a heating zone to soften the core yarn;

(c) withdrawing the core yarn from the heating zone and converging the effect yarn under essentially tensionless conditions while simultaneously wrapping the effect yarn around the core yarn in a constant direction; and, (d) periodically moving the point of convergence along the core yarn at a speed greater than the travel speed of and in the direction of travel of the core yarn for a determined length, then returning the point of convergence to its original position.

7. The process of claim 6 in which the wrapping zone is located in the falsetwist zone of a falsetwist-texturing machine.

8. The process of claim 6 including the additional step of tangling the combined core-effect yarns before winding.

9. The process of claim 6 wherein the effect yarn is converged with the core yarn from a direction opposite the direction of travel of the core yarn.

* * * * *